United States Patent [19]

Collins

[11] 4,422,505

[45] Dec. 27, 1983

[54] METHOD FOR GASIFYING SUBTERRANEAN COAL DEPOSITS

[75] Inventor: Kenneth L. Collins, Houston, Tex.

[73] Assignee: Atlantic Richfield Company, Los Angeles, Calif.

[21] Appl. No.: 337,566

[22] Filed: Jan. 7, 1982

[51] Int. Cl.[3] ..... C10J 5/00; E21B 43/243; E21C 43/00

[52] U.S. Cl. ..... 166/256; 166/245

[58] Field of Search ..... 166/256, 259, 260, 261, 166/251, 50, 245, 297

[56] References Cited

U.S. PATENT DOCUMENTS

| | | | |
|---|---|---|---|
| 2,914,309 | 11/1959 | Salomonsson | 166/256 X |
| 3,017,168 | 1/1962 | Carr | 166/256 X |
| 3,024,013 | 3/1962 | Rogers et al. | 166/256 |
| 3,563,606 | 2/1971 | Sears | 166/259 X |
| 4,036,298 | 7/1977 | Kreinin et al. | 166/256 X |
| 4,062,404 | 12/1977 | Pasini et al. | 166/259 |
| 4,069,867 | 1/1978 | Bissett | 166/256 |
| 4,220,203 | 9/1980 | Steeman | 166/259 X |
| 4,222,437 | 9/1980 | Sabol | 166/256 X |
| 4,368,781 | 1/1983 | Anderson | 166/50 X |

*Primary Examiner*—Stephen J. Novosad
*Attorney, Agent, or Firm*—F. Lindsey Scott

[57] ABSTRACT

A method for gasifying subterranean coal deposits by positioning a cased injection well to extend from the surface into the coal deposit with the injection well extending horizontally through the lower portion of the coal deposit with the horizontal portion of the well being cased with a perforated casing; positioning an injection tubing in the injection well; positioning a production well to extend from the surface to a point near the lower end of the injection well; igniting the coal deposit; gasifying a portion of the coal deposit between the bottom of the production well and the lower end of the injection tubing well by injecting a free-oxygen containing gas into the coal deposit through the injection tubing and recovering product gases through the production well and thereafter gasifying a second portion of the coal deposit by withdrawing the injection tubing a selected distance and thereafter injecting free-oxygen containing gas into the coal deposit and recovering product gases from the production well.

10 Claims, 3 Drawing Figures

METHOD FOR GASIFYING SUBTERRANEAN COAL DEPOSITS

BACKGROUND OF THE INVENTION

This invention relates to the in situ gasification of subterranean coal deposits.

In recent years, there has been considerable interest in the development of methods for the recovery of heating values from subterranean coal deposits which are not readily mined by conventional mining methods. One method for recovering heating values from such coal reserves is in situ gasification. In general, such processes involve the partial oxidation of subterranean coal deposits by the injection of a free-oxygen containing gas to produce a product gas which is recovered from the coal seam and processed to produce heat, synthetic natural gas or a variety of other products. The product gases so recovered contain substantial heating value as well known to the art. In general, such processes have utilized an injection well and a product recovery well for the gasification of the subterranean coal deposits. Many variations and modifications of this approach have been used, including a plurality of wells, slanted wells, and the like.

In one such method, as set forth in "The Controlled Retracting Injection Point (CRIP) System: A Modified Stream Method for In Situ Coal Gasification", R. W. Hill and M. J. Shannon, Proceedings of Seventh Underground Coal Conversion Symposium, Fall Leaf Lake, Calif., Sept. 8–11, 1981, a horizontal borehole was used for the injection of free-oxygen containing gas. In general, the method disclosed comprises the use of a horizontal borehole containing an injection tubing through which gas is passed to a discharge point in the vicinity of a production well. The gasification of the subterranean coal deposit occurs in the vicinity of the free-oxygen containing gas discharge point to produce product gases which are recovered through the production well. When the portion of the coal deposit in the vicinity of the free-oxygen containing gas outlet has been consumed, the tubing is severed at a point so that an additional portion of the coal deposit can be gasified. The tubing is severed by the use of wire-line tools, explosives, pyrophoric materials, or the like.

Other references which were considered in the preparation of the present application are as follows: LLNL Underground Coal Gasification Project: Quarterly Progress Report—October through December, 1980, Editors D. U. Olness and Wallace Clements, Jan. 26, 1981, UCRL-50026-80-4; and "Elf Drills 1000+Feet Horizontally", Andre P. Jourdan and Guy A. Baron, Petroleum Engineer International, September, 1981, pp. 51–58.

As a result of the continuing interest in the in situ gasification of subterranean coal deposits, a continuing search has been directed to the development of improved methods whereby such coal can be gasified more economically and and reliably.

BRIEF SUMMARY OF THE INVENTION

It has now been found that subterranean coal deposits are readily gasified economically and reliably by a process which comprises: (a) positioning a cased injection well to extend from the surface into the subterranean coal deposit and substantially horizontally through a lower portion of the coal deposit, with at least a major portion of the casing in the horizontal portion of the cased injection well being perforated casing; (b) positioning an injection tubing in the cased injection well for the injection of a free-oxygen containing gas into the coal deposit; (c) positioning a production well to extend from the surface to the coal deposit with a lower end of the production well being located near and in fluid communication with a lower end of the cased injection well; (d) igniting the coal deposit; (e) gasifying a first portion of the coal deposit between the production well and the lower end of the injection tubing by injecting free-oxygen containing gas into the coal deposit through the injection tubing and recovering product gases through the production well; and, (f) gasifying a second portion of the coal deposit by withdrawing the injection tubing a selected distance and thereafter injecting free-oxygen containing gas into the second portion of the coal deposit and recovering product gases through the production well.

DETAILED DESCRIPTION OF THE INVENTION

Figure 1:
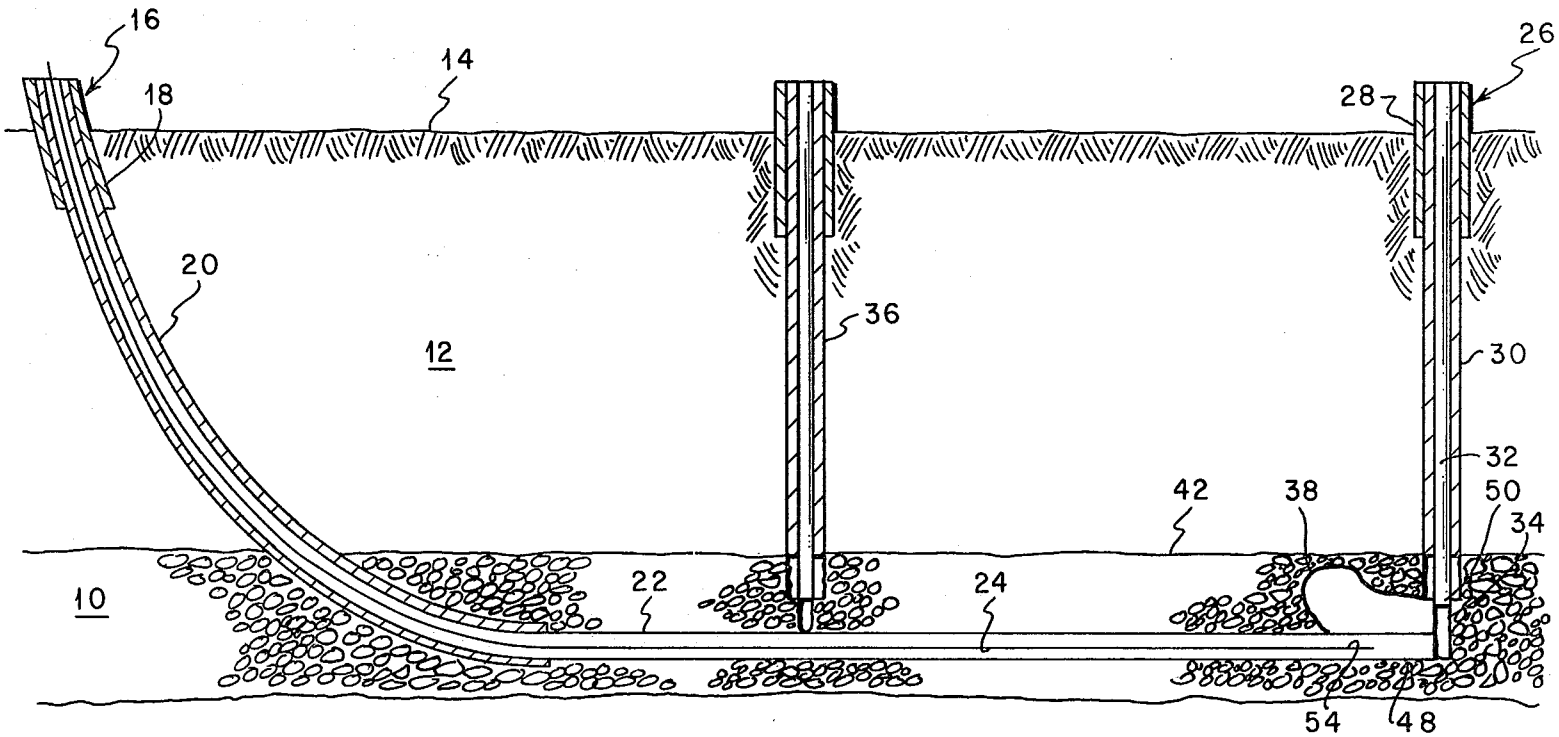
FIG. 1 is a schematic diagram of an embodiment of the method of the present invention.

In the discussion of the Figures, the same numbers will be used throughout to refer to the same or similar components. In FIG. 1, a coal deposit 10 positioned beneath an overburden 12 is shown. An injection well 16 is shown extending from the surface 14 into coal deposit 10. Injection well 16 comprises a conductor 18 which is a relatively large casing which extends a short distance beneath surface 14, a second casing 20 which extends to the horizontal section of injection well 16, and a perforated casing 22 which extends along the length of the horizontal portion of injection well 16. An injection tubing 24 is positioned to extend from the surface through casing 22. Injection tubing 24 extends through perforated casing 22 to a selected distance from the end of perforated casing 22.

A production well 26 is shown extending from the surface 14 into coal deposit 10 with its lower end being positioned near and in fluid communication with the lower end 48 of perforated casing 22. Production well 26 comprises a conductor 28 which is a relatively large casing which extends a short distance beneath surface 14, a second casing 30 which extends to the top 42 of coal deposit 10, and a production casing 32 which extends a further distance into coal deposit 10. Normally, production casing 32 is cemented in place as are the other casings used. Preferably, an open hole section 34 is left beneath the lower end 50 of production casing 32. A second production well 36, which is similar to production well 26, is shown. Second production well 36 is drilled to nearly intersect perforated casing 22.

Figure 3:
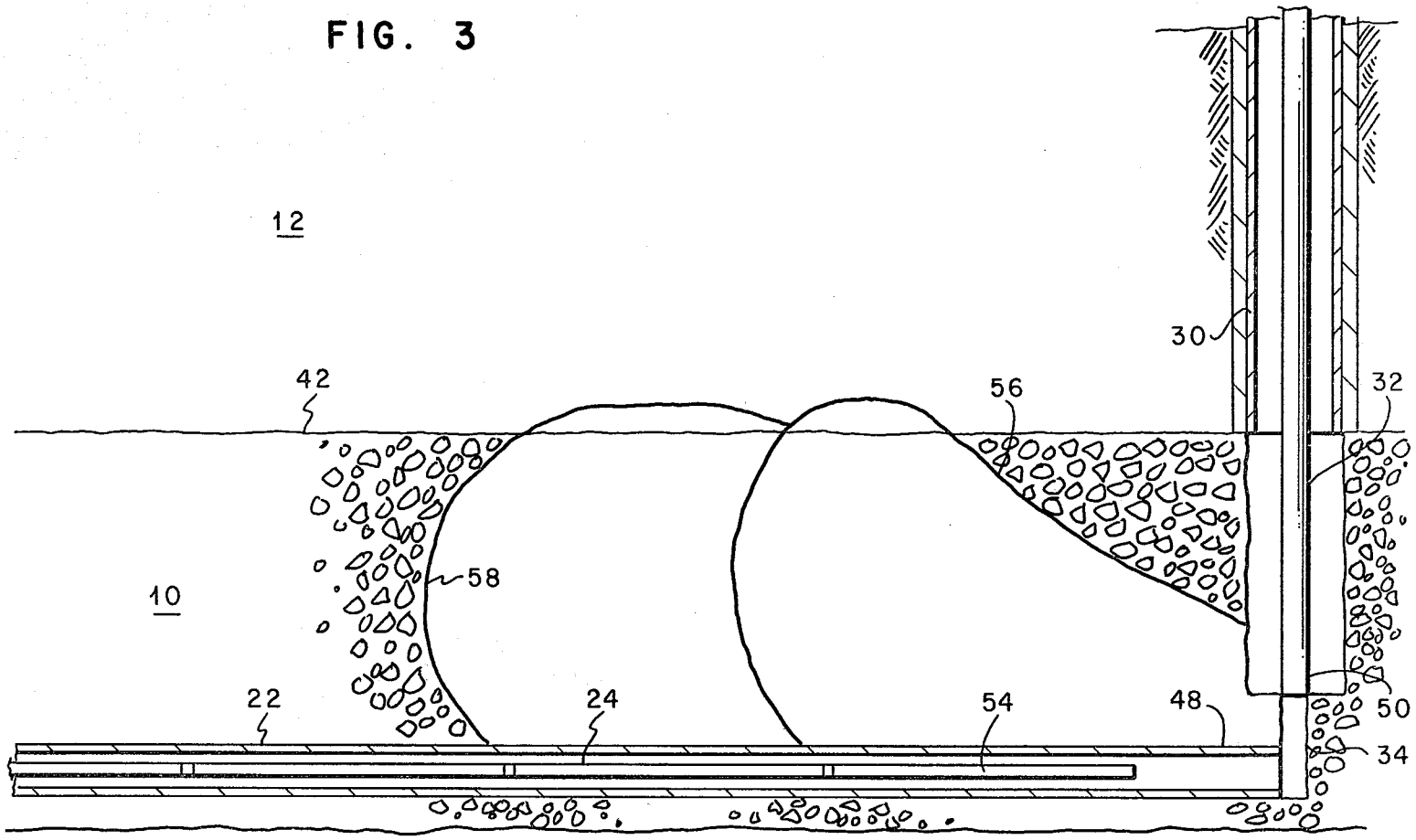
FIG. 3 is schematic diagram of the end of the cased wellbore shown in FIG. 1 and the production well.

In the practice of the present invention, after the completion of injection well 16 and production well 26, coal deposit 10 is ignited as known to those skilled in the art with a free-oxygen containing gas being injected through injection tubing 24 to maintain combustion between production well 26 and the lower end 54 of injection tubing 24. The combustion cavity resulting from the combustion of coal deposit 10 between production well 26 and lower end 54 of injection tubing 24 is shown as a cavity 38 in FIG. 1. It will be understood that the shape of the combustion cavity will vary widely and is not readily predicted with precision. When gasification of coal deposit 10 between production well 26 and lower end 54 of injection tubing 24 has been completed, injection tubing 24 is withdrawn a selected distance and thereafter injection is continued at a reduced rate until a reverse combustion link is established between cavity 38 and the lower end of injection tubing 24. Thereafter injection is continued at an increased rate to continue the gasification of coal deposit 10. As the gasification process is continued, larger cavities, such as shown by lines 56 and 58 in FIG. 3, are produced. It will be clear that in the gasification of coal deposit 10 to this extent portions of overburden 12 may collapse into the combustion cavity. Such is well known to the art and does not merit further discussion. Perforated casing 22 normally is oxidized or collapsed in the areas downstream from the injection point of the free-oxygen containing gas. As a result, the free-oxygen containing gas is injected into coal deposit 10 in the vicinity of lower end 54 of injection tubing 24. Desirably, a high temperature alloy injection nozzle is positioned on lower end 54 of injection tubing 24. This nozzle is shown in FIG. 3 as the end section of tubing 24 is desirably of a high temperature alloy material such as stainless steel or the like. Such materials are well known to those skilled in the art and need not be discussed further.

Figure 2:
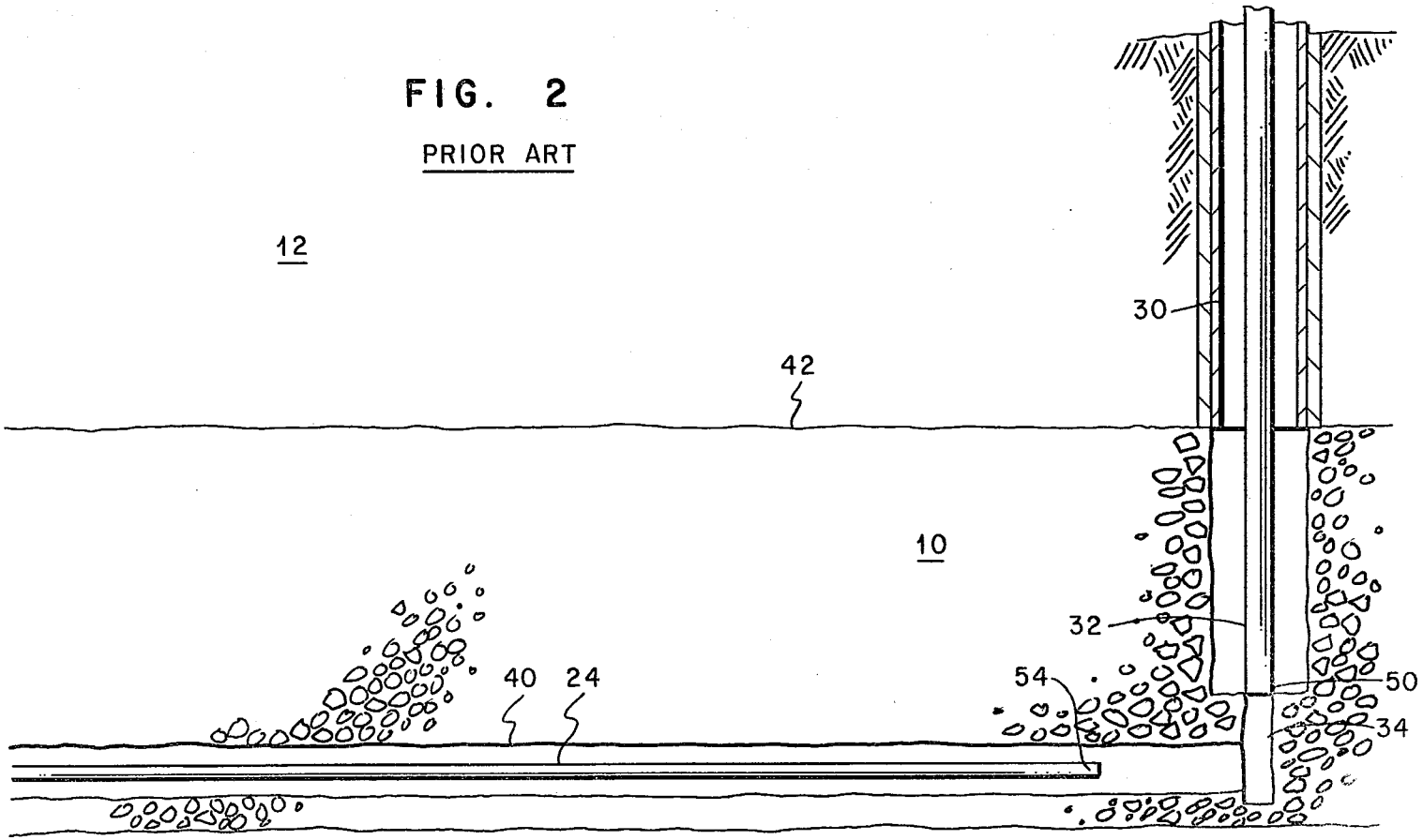
FIG. 2 PRIOR ART
FIG. 2 is a schematic diagram of an embodiment of a prior art process.

In FIG. 2, a prior art process is shown. In the process shown in FIG. 2 an open wellbore 40 is drilled to permit the positioning of injection tubing 24 in coal deposit 10. In the practice of the invention shown in FIG. 2, the coal is gasified as described in conjunction with FIG. 1, however, upon completion of the gasification of coal deposit 10 in the vicinity of lower end 54 of injection tubing 24, it is proposed in the prior art method to use wire-line cutting tools, pyrophorics, or explosives to sever or perforate injection tubing 24 at a new location to permit the gasification of additional portions of coal deposit 10. As is well known to those skilled in the art, the use of wire-line tools in horizontal holes is difficult. Further, the use of devices for the positioning of pyrophorics or the like in tubing 24 is also difficult in horizontal holes. Further, the use of such techniques requires that the process be interrupted during the severing of injection tubing 24. Such interruptions can create serious problems when the interruption is long enough to result in extinguishing the gasification process and, when the gasification process must be operated under pressure, it makes it difficult to maintain pressure in the gasification zone during the severing process. It appears that such techniques are deemed necessary because it is not contemplated that injection tubing 24 can be withdrawn through the open hole 40 after the gasification process has been initiated.

By Applicant's claimed method, injection well 16 is cased and injection tubing 24 is positioned in the cased horizontal wellbore. Such permits the withdrawal of injection tubing 24 at a desired rate when it is desirable to move the injection point for the free-oxygen containing gas. When it is desired to move the injection point, in Applicant's claimed process, the tubing is withdrawn a convenient distance, which in many instances will be one tubing joint length, and injection is continued. It will be noted that injection can be substantially continuous by Applicant's claimed method, whereas by the prior art method, an interruption is necessary. Such un-interrupted operation is highly beneficial in continuing efficient gasification process operation and in maintaining pressure in the gasification zone.

In the event that it is necessary to interrupt gas injection through injection tubing 24, in the practice of the Applicant's claimed method, injection can alternately be accomplished down the annulus between well casing 22 and injection tubing 24.

In some instances it may be desirable to assemble injection tubing 24, which is normally a plurality of tubing joints joined together to form an injection tubing, so that the portion of injection tubing 24 which extends downwardly from surface 14 to the horizontal section of injection well 16 is substantially stronger than the injection tubing extending horizontally through perforated casing 22. It may be further desirable to fabricate the joints in the portion of injection tubing 24 in perforated casing 22 so that the joints are progressively weaker with increasing length from the beginning of the horizontal section of well 16. In other words, injection tubing 24 is of decreasing strength with increasing length from the surface end of injection tubing 24. Such variations in the strength of injection tubing 24 give a measure of control over where breakage of tubing 24 would occur in the event that tubing 24 sticks in perforated casing 22. Such control is desirable in the event that breaks in injection tubing 24 occur so that continued operation may be accomplished. In many instances it may not be desirable to include such a variation of strength in injection tubing 24, although in some instance it may be desirable to do so.

In general, it is contemplated that perforated casing 22 will be oxidized, melted, or otherwise destroyed beneath the gasification zone. Accordingly, slotted casing 22 is fabricated of materials which are not resistant to high temperature, and perforated casing 22 may be of plastic or the like. In general, perforated casing 22 may be any suitable perforated casing material such as a slotted screen, slotted casing, perforated casing, or the like so long as the openings in the casing are small enough to prevent sloughing or collapse of the formation into the wellbore, but large enough for adequate air flow through the perforations.

In the practice of the present invention, a plurality of production wells may be used. One such production well is shown as second production well 36. These production wells are desirably positioned along the length of injection well 16 and are used after the gasification process has moved through coal deposit 10 to a point beyond second wellbore 36. At this point, first wellbore 26 is closed in and second production wellbore 36 is used for the production of gases from the gasification of coal deposit 10. Clearly, a plurality of such wells along the length of injection well 16 can be used. The spacing of such wells will be dependent upon a multitude of variables known to those skilled in the art.

By the practice of the present invention, the use of vertical gas injection wells is eliminated. Such is a significant improvement in the gasification process, since vertical gas injection wells are normally located over a zone which is highly susceptible to subsidence. Accordingly, the positioning and maintenance of gas injection wells is a major problem in underground coal gasification projects. By the process of the present invention, this difficulty is eliminated since no vertical gas injection wells are used. Further, in the operation of vertical injection wells, it is normally necessary to use coolant to attempt to protect the well from the high temperatures encountered in the gasification zone. No such coolant costs are incurred in the practice of the present invention. Further, in the practice of the present invention the surface piping required for the injection of the free-oxygen containing gas is connected to a single source for the gasification of a substantial area of coal deposit 10, as opposed to the use of a plurality of vertical gas injection wells. Further, the use of the horizontal well as set forth herein results in greater predictability in the underground coal gasification process.

The drilling and completion of injection well 16 is accomplished by techniques known to those skilled in the art and it will be clearly understood that injection well 16 could be slant drilled from the surface to position the horizontal portion of injection well 16 in coal seam 10 or injection well 16 could be started vertically from the surface when a suitable depth of overburden is available to curve the wellbore. Such variations are well known to those skilled in the art as are the methods for casing and completing such wells. No novelty is considered to lie in the particular method for drilling and completing the wellbore as described herein. The drilling of such horizontal wellbores is described in "Elf Drills 1000+Feet Horizontally", Andre P. Jourdan and Gary A. Baron, Petroleum Engineer International, September, 1981, pp. 51–58, which is hereby incorporated in its entirety by reference.

Having thus described the present invention by reference to certain of its preferred embodiments, it is respectfully pointed out that the embodiments described are illustrative rather than limiting in nature and that many variations and modifications are possible within the scope of the present invention.

Having thus described the invention, I claim:

1. A method for gasifying a subterranean coal deposit, said method consisting essentially of:

(a) positioning a cased injection well to extend from the surface into said subterranean coal deposit and substantially horizontally through a lower portion of said coal deposit, with at least a major portion of the casing in the horizontal portion of said cased injection well being perforated casing;

(b) positioning an injection tubing in said cased injection well for the injection of a free-oxygen containing gas into said coal deposit;

(c) positioning a production well to extend from the surface to said coal deposit with a lower end of said production well being located near and in fluid communication with a lower end of said cased injection well;

(d) igniting said coal deposit;

(e) gasifying a first portion of said coal deposit between said production well and a lower end of said injection tubing by injecting free-oxygen containing gas into said coal deposit through said injection tubing and recovering product gases through said production well; and, (f) gasifying a second portion of said coal deposit by withdrawing said injection tubing a selected distance and thereafter injecting free-oxygen containing gas into said second portion of said coal deposit and recovering product gases through said production well.

2. The method of claim 1 wherein a plurality of portions of said coal deposit are gasified.

3. The method of claim 2 wherein a plurality of production wells are used, said plurality of production wells being positioned along said horizontal portion of said cased injection wells.

4. The method of claim 1 wherein said injection tubing includes an injection nozzle of a high temperature alloy positioned on its lower end.

5. The method of claim 1 wherein said injection tubing comprises a plurality of tubing lengths joined at a plurality of joints.

6. The method of claim 1 wherein said injection tubing is of decreasing strength with increasing length from the surface end of said injection tubing.

7. In a method for gasifying a subterranean coal deposit, said method consisting essentially of:

(a) positioning an injection well to extend from the surface into said subterranean coal deposit and substantially horizontally through a lower portion of said coal deposit;

(b) positioning an injection tubing in said injection well for the injection of free-oxygen containing gas into said coal deposit;

(c) positioning a production well to extend from the surface to said coal deposit with a lower end of said production well being located near and in fluid communication with a lower end of said injection well;

(d) igniting said coal deposit;

(e) gasifying a first portion of said coal deposit between said production well and a lower end of said injection tubing by injecting free-oxygen containing gas into said coal deposit through said injection tubing and recovering product gases through said production well; and, (f) gasifying a second portion of said coal deposit by moving the lower end of said injection tubing by severing said injection tubing at a selected point and thereafter injecting free-oxygen containing gas into said second portion of said coal deposit and recovering product gases through said production well;

the improvement comprising:

(g) casing said injection well with a least a major portion of the casing in the horizontal portion of said injection well being perforated casing; and, (h) moving said lower end of said injection tubing by withdrawing said injection tubing a selected distance.

8. The improvement of claim 7 wherein said injection tubing comprises a plurality of tubing lengths joined at a plurality of joints.

9. The improvement of claim 8 wherein said injection tubing is of decreasing strength with increasing distance from the surface end of said injection tubing.

10. The improvement of claim 7 wherein said injection tubing includes an injection nozzle of a high temperature alloy positioned on its lower end.

* * * * *